US005109762A

United States Patent [19]

Tetrault

[11] Patent Number: 5,109,762

[45] Date of Patent: May 5, 1992

[54] METHOD AND APPARATUS FOR SECURING A PILE OF NEWSPAPERS OR MAGAZINES OR OTHER MATERIALS

[76] Inventor: Gregory J. Tetrault, 2925 W. 40th St., Minneapolis, Minn. 55410

[21] Appl. No.: 563,082

[22] Filed: Aug. 6, 1990

[51] Int. Cl.[5] ..... B65B 27/08; B65B 13/02

[52] U.S. Cl. ..... 100/2; 100/34

[58] Field of Search ..... 100/1, 2, 34; 229/125.22, 125.38; 206/83.5, 597, 610, 618

[56] References Cited

U.S. PATENT DOCUMENTS

| | | | |
|---|---|---|---|
| 684,573 | 10/1901 | Howe . | |
| 915,503 | 3/1909 | Stryker . | |
| 956,941 | 5/1910 | Chapman . | |
| 1,155,740 | 10/1915 | LaCroix | 206/618 |
| 1,160,818 | 11/1915 | Barlow . | |
| 1,191,051 | 7/1916 | Wichmann . | |
| 1,376,872 | 5/1921 | Greve . | |
| 1,473,576 | 11/1923 | Greve . | |
| 2,771,237 | 11/1956 | Philipson | 229/125.22 |
| 3,298,598 | 1/1967 | Eberstadt | 206/618 |
| 3,370,779 | 2/1968 | Cole . | |
| 3,780,854 | 12/1973 | Ruppenthal . | |

*Primary Examiner*—Harvey C. Hornsby
*Assistant Examiner*—Terrence R. Till
*Attorney, Agent, or Firm*—Hugh D. Jaeger

[57] ABSTRACT

Two pieces of material such as paper stock secured about the edges. A pull tab at about a mid-portion of each edge of the paper between pull tab at a mid-portion of each edge of the sealed members and a length of material randomly positioned between the papers or fan folded between the papers for securing a subsequent bundle of newspapers or magazines placed on top of the sheets of papers. The opposing pull tabs are pulled out and a finite length of string or other material is fastened between the two which is used to subsequently tie or tape the bundles of newspapers or magazines.

5 Claims, 6 Drawing Sheets

METHOD AND APPARATUS FOR SECURING A PILE OF NEWSPAPERS OR MAGAZINES OR OTHER MATERIALS

BACKGROUND TO THE INVENTION

1. Field of the Invention

The present invention pertains to a method and apparatus for tieing bundles of newspapers or magazines or any other materials, and more particularly, it pertains to a self-contained system including finite lengths of string or other securing material for securing a pile of material into a fixed bundle.

2. Description of the Prior Art

The prior art methods of securing bundles of newspapers or magazines has been using either lengths of string, filament tapes, or any other forms of bundling newspapers or magazines such as old brown paper grocery bags. These methods have been less than perfect and do not always provide for rapid disposal of newspapers and magazines.

With the advent of recycling and further with the advent of land fills rejecting bundles of newspapers and magazines because of their slow decomposition, it is more important to provide systems for rapid bundling and subsequent handling of materials for recycling.

The present invention overcomes the disadvantages of the prior art by providing an apparatus for bundling of newspapers and magazines.

SUMMARY OF THE INVENTION

The general purpose of the present invention is to provide a method and apparatus for bundling of newspapers and magazines or other materials which includes enclosed finite lengths of string, tape or other fan folded material for securing the newspapers and magazines into a bundle. Another general purpose of the present invention is to also provide an apparatus which conveys advertising information at the same time prior to utilization. Advertising material can be printed on either side of the sheets of paper which form the apparatus. There can also be provided additional sheets which are folded about the edges of the structure supporting the finite lengths of string or tape.

According to one embodiment of the present invention, there are provided two sheets of material which are secured about the edges including a tear-away tab portion at a mid-portion of each edge. Two lengths of finite material are connected between the tab portions and fan folded and more randomly disposed between the sheets of material for subsequent pulling out and being tied about a pile of newspapers or magazines or other materials. In operation, an individual places the secured sheets of materials on a flat surface, places a pile of magazines, newspapers or other materials on top of the two sheets of material, then pulls the tabs thereby pulling out the finite lengths of material and subsequently secures the string or tape materials about each other over the pile of newspapers, magazines or other materials.

Significant aspects and features of the present invention include a combination of two sheets of material secured together which can be printed on carrying advertising or other graphic or printed information. The sheets can also include other sheets of materials secured thereto for displaying graphic or printed information in an advertising or other format.

Another significant aspect and feature of the present invention is a system for securing piles of newspapers or magazines in which can be economically utilized not only by the manufacture in cost of manufacture but by the end user.

Having thus described the preferred embodiments of the present invention, it is a principal object hereof to provide a system for bundling a pile of newspapers, magazines or other materials for subsequent environmentally effective disposition.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
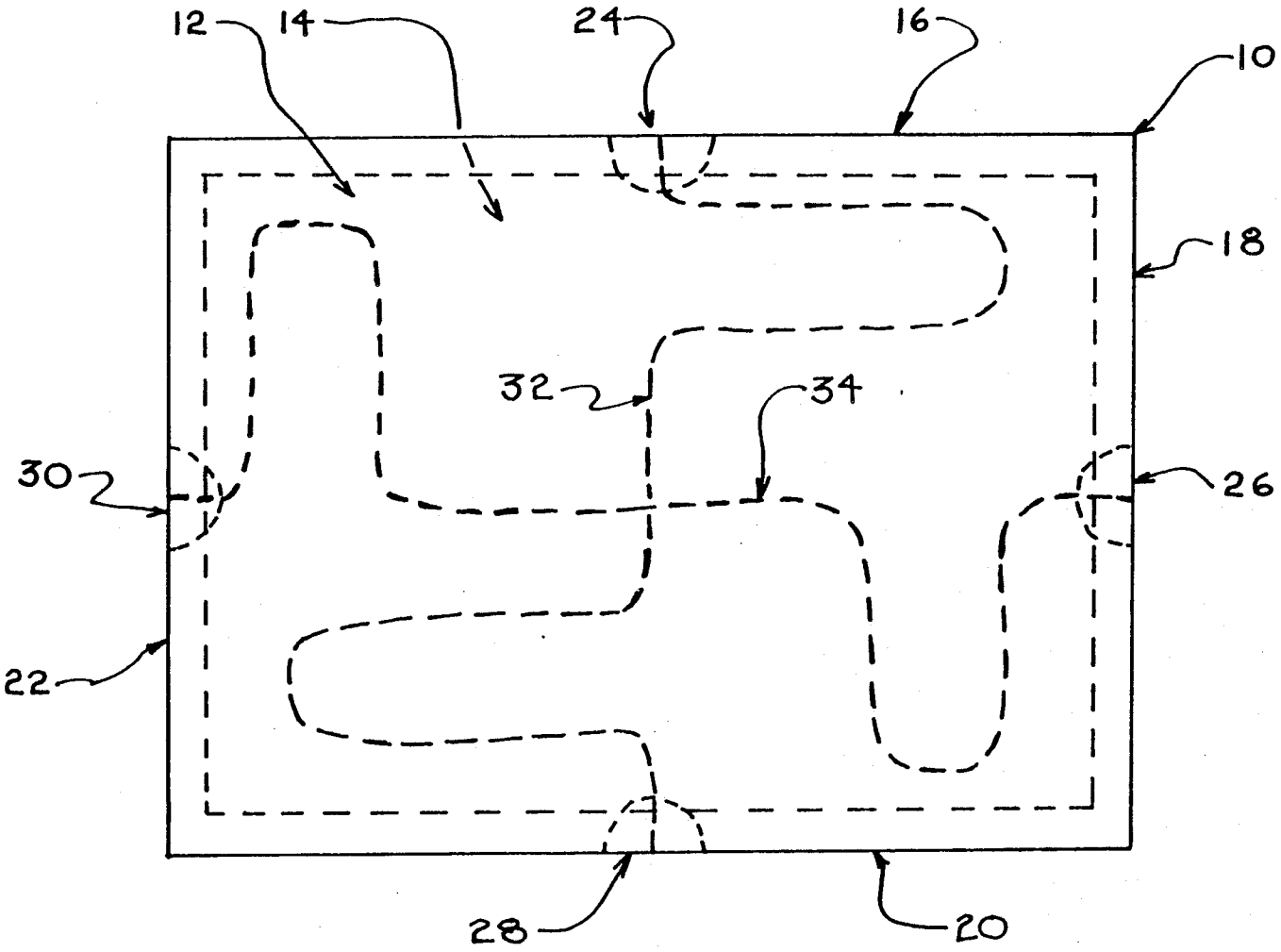
FIG. 1 illustrates a top view of the present invention.
Figure 2:
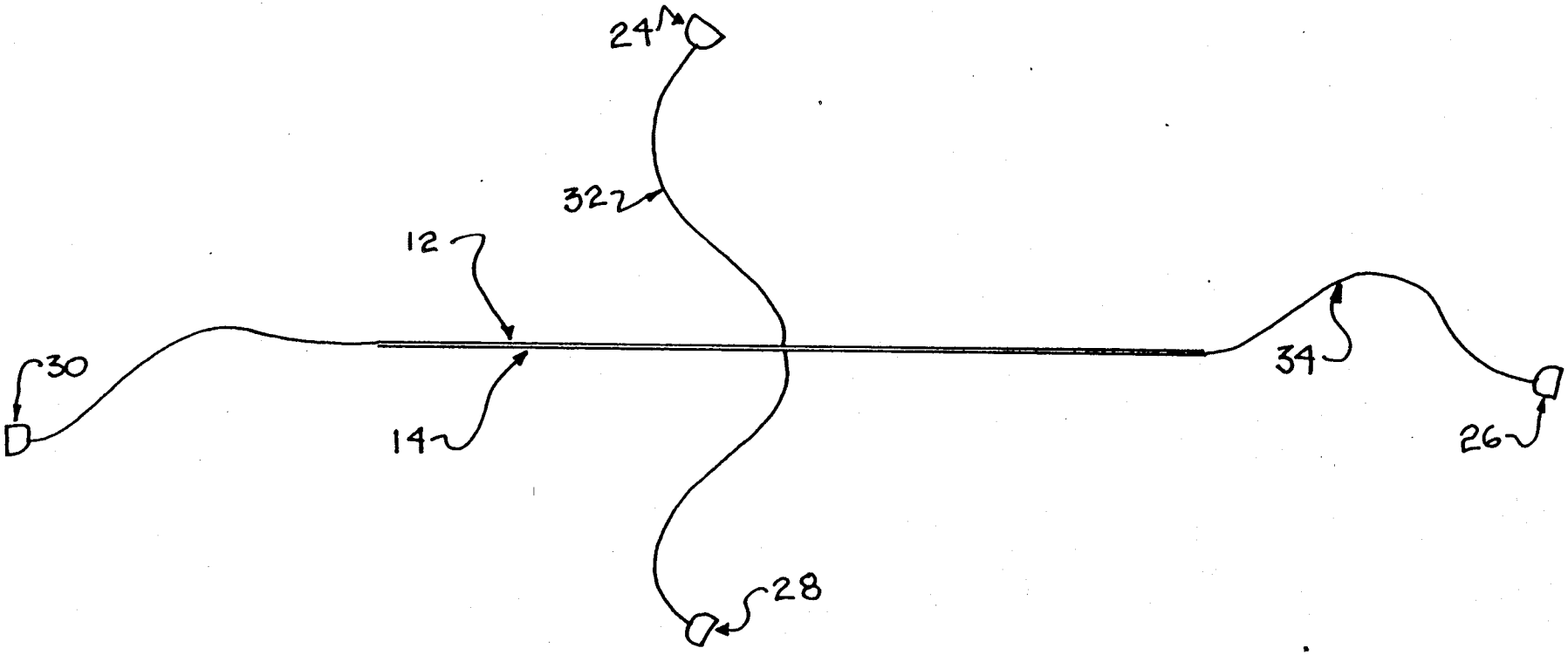
FIG. 2 illustrates a side view of the present invention.

FIG. 1 illustrates a top view of the apparatus for bundling of a pile of newspapers or magazines referred to as a recycler 10, the present invention, including a top sheet 12, a bottom sheet 14 illustrated in FIG. 2, a secured edge 16, 18, 20, 22 perforated pull tabs 24, 26, 28 and 30 connected to lengths of material 32 and 34. The top and bottom sheets 12 and 14 can be paper, cardboard, polymer or any other suitable materials. The securing of the two sheets of paper can be by glue, mechanical perforations, or any other suitable securing methods in view of the type of material being secured at the edges. The finite lengths of material can be either string, twine, polymer string or tape, filament tape or any other suitable material. The sheet material can be paper, cardboard, polymer or nonrip-nontear material.

FIG. 2 illustrates a side view of the present invention while numerals correspond to those elements previously described.

Figure 3:
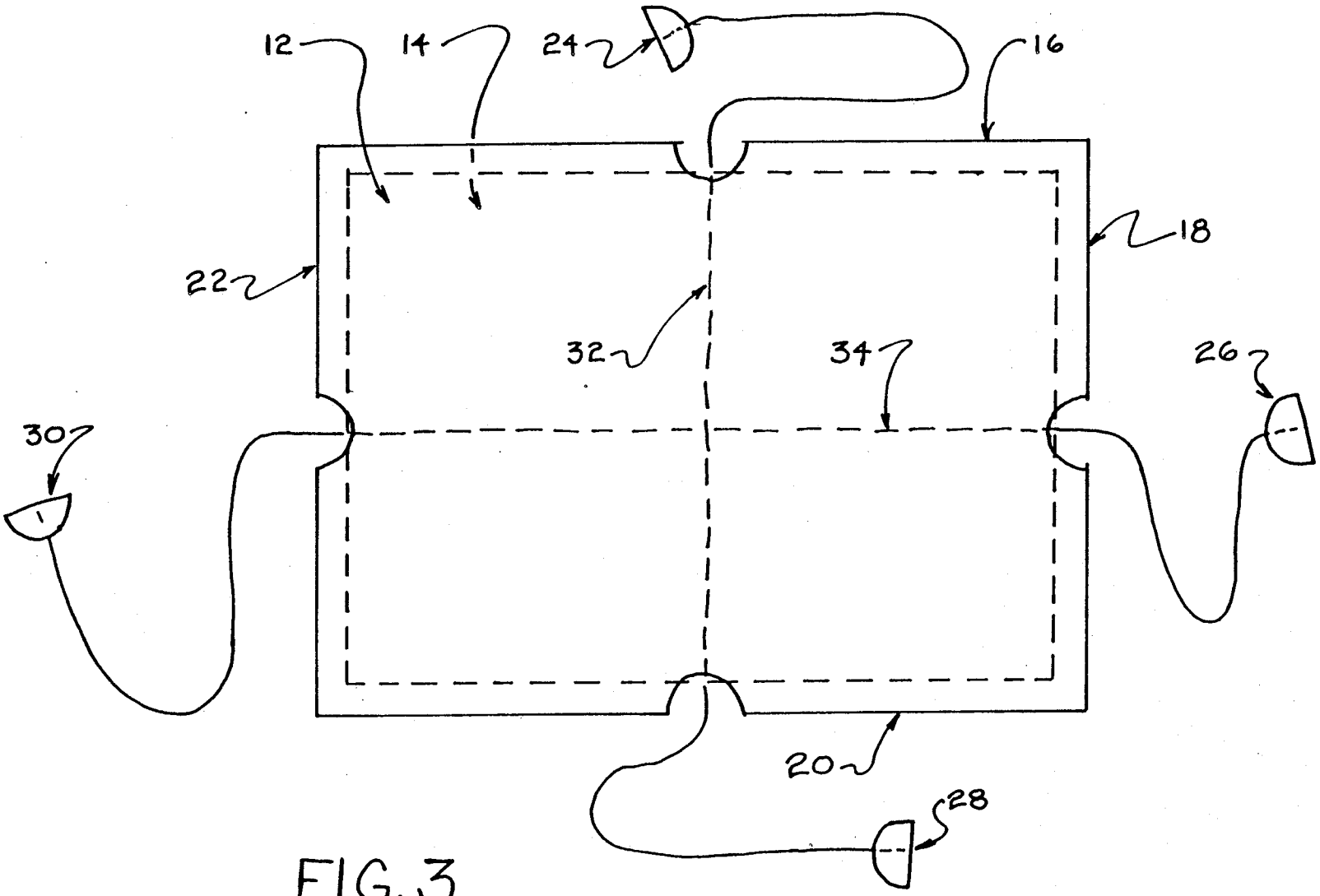
FIG. 3 illustrates a plan view of the present invention prior to bundling.

FIG. 3 illustrates a plan view of the invention prior to bundling and after the perforated pull tabs have been pulled thereby straightening the lengths of string or tape or other material within the folded sheets of paper.

MODE OF OPERATION

Figure 4:
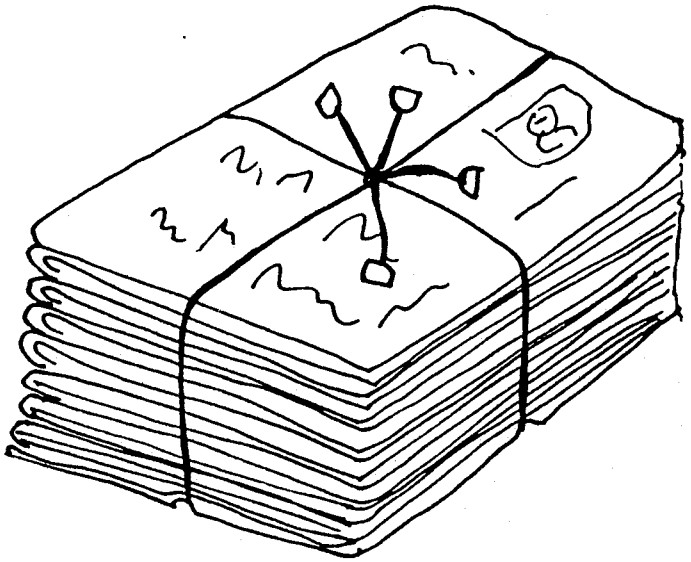
FIG. 4 illustrates a perspective view of the utilization of the present invention.

FIG. 4 illustrates a perspective view of a bundled newspapers or magazines. The recycler sheets are on the bottom with the securers engaged about the pile of papers or magazines.

FIRST ALTERNATIVE EMBODIMENT

Figure 5:
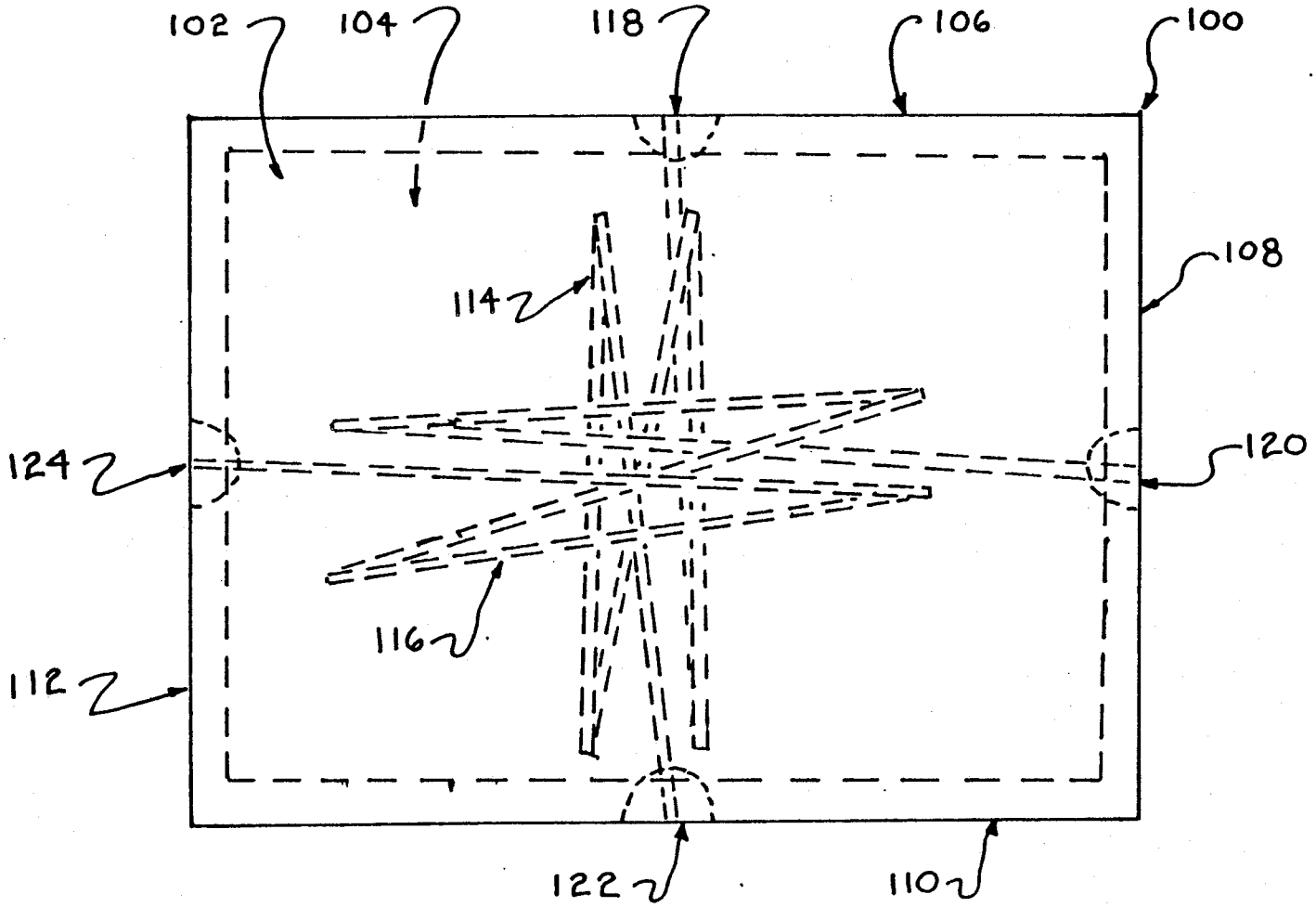
FIG. 5 illustrates a plan view of a first alternative embodiment of sheets with fan folded tape; and, FIG. 6 illustrates a second alternative embodiment of sheets with an additional sheet for graphics or information.

FIG 5 illustrates a plan view of a first alternative embodiment of a recycler sheet 100 including two sheets 102 and 104, secured edges 106, 108, 110 and 112, fan folded tape 114 and 116 connected to perforated pull tabs 118, 120, 122 and 124. The tape can be suitable polymer tape or even a reinforced filament tape. The tape can be either fan folded in an organized manner or arbitrarily folded between the sheets. Operation is like that of FIGS. 1–4 except that tape is taped over itself for preferred operation.

SECOND ALTERNATIVE EMBODIMENT

Figure 6:
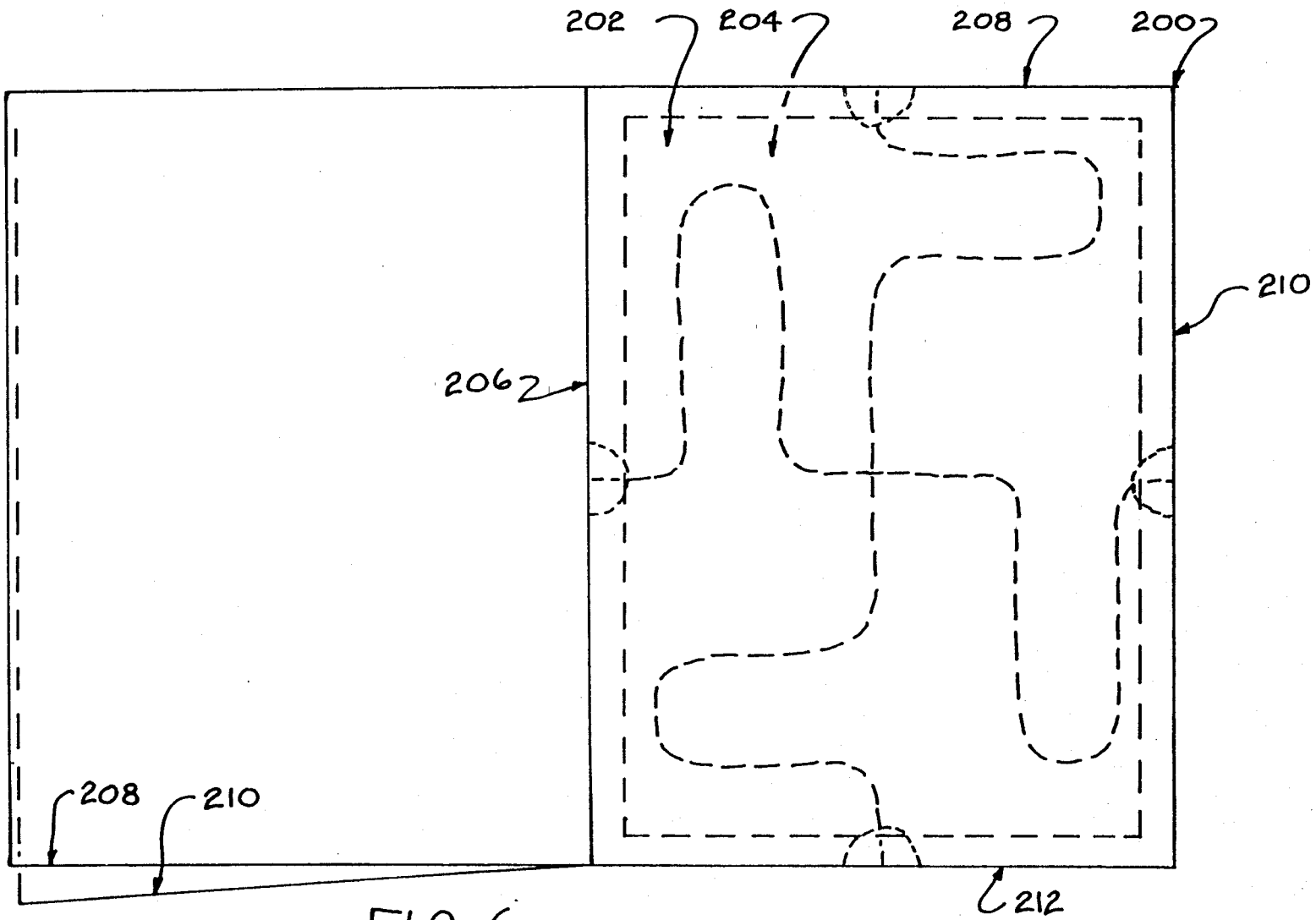

FIG. 6 illustrates a plan view of a second alternative embodiment of a recycler sheet 200 including two elongated sheets 202 and 204 for printed graphics or printed information. The sheets are secured about the edges including edge 206. The additional sheet areas 208 and 210 as illustrated on the left side of the drawing provide four additional surface areas for printing of information and/or graphics. The sheets could also be joined together either by gluing or perforating, etc., but this would allow less printing area.

Various modifications can be made to the present invention without departing from the apparent scope hereof.

I claim:

1. A recycling apparatus for securing a pile of newspapers or magazines comprising:

a. a first rectangular planar sheet of paper material with four integral perforated tabs substantially at a mid-point of each side;

b. a first length of securing material positioned on said sheet of material, each end of said securing material secured to each of said integral perforated tabs which oppose each other;

c. a second length of said securing material positioned on said sheet of paper material, each end of said securing material secured to said integral perforated tabs which oppose each other; and, d. a second planar sheet of paper material positioned over said first sheet of paper and over said first and second lengths of said securing material and said sheets of materials secured about the edges whereby said integral perforated tabs with said securing material are pulled to detach said tabs from said first planar sheet to stretch out said securing material for securing about a pile of materials.

2. The apparatus of claim 1 for securing a pile of material such as newspapers or magazines wherein said sheet of material is selected from the group of paper, cardboard, polymer, or nontear-nonrip material.

3. The apparatus of claim 1 for securing a pile of materials such as newspapers or magazines wherein said securing material is selected from the group of string, twine, polymer string, polymer tape or filament tape.

4. The apparatus of claim 1 for securing a pile of materials such as newspapers or magazines wherein said sheets include printed or graphics information.

5. Method for securing a pile of material comprising the steps of:

a. laying a recycling apparatus of claim 2 on a flat surfacer; placing a pile of materials on said first planar sheet;

b. pulling opposing first integral perforated tabs to detach said tabs from said planar sheet with securing material outward, up and around a pile of materials;

c. securing said securing material to itself about said pile of materials;

d. pulling opposing second integral perforated tabs to detach said tabs from said planar sheet with securing material outward, up and around said pile of materials; and, e. securing said securing apparatus to itself about said pile of materials whereby said securing materials tie or strap about said pile of materials.

* * * * *